United States Patent [19]

Rayner

[11] 4,302,900

[45] Dec. 1, 1981

[54] NODAL ELEMENTS WITH CHANNELS FOR PUSH-FITTED RODS

[76] Inventor: William R. Rayner, 40 Rawson St., Epping, N.S.W., 2121, Australia

[21] Appl. No.: 208,117

[22] Filed: Nov. 18, 1980

[30] Foreign Application Priority Data

Nov. 27, 1979 [AU] Australia ..... PE1486

[51] Int. Cl.[3] ..... A63H 33/10

[52] U.S. Cl. ..... 46/29

[58] Field of Search ..... 46/29, 28, 26; 434/278

[56] References Cited

U.S. PATENT DOCUMENTS

| | | | |
|---|---|---|---|
| 1,281,832 | 10/1918 | Post | 46/29 |
| 2,410,874 | 11/1946 | Greenberg et al. | 46/29 |
| 2,942,356 | 6/1960 | Weintraub | 434/278 |
| 3,458,949 | 8/1969 | Young | 46/29 |
| 3,747,261 | 7/1973 | Salem | 46/26 |

FOREIGN PATENT DOCUMENTS

| | | | |
|---|---|---|---|
| 2731740 | 1/1979 | Fed. Rep. of Germany | 46/29 |
| 1128097 | 8/1956 | France | 46/26 |
| 340357 | 1/1931 | United Kingdom | 46/29 |
| 2034186 | 6/1980 | United Kingdom | 46/29 |

*Primary Examiner*—F. Barry Shay

*Attorney, Agent, or Firm*—Stevens, Davis, Miller & Mosher

[57] ABSTRACT

A constructional toy having a plurality of nodal elements and a plurality of co-operating rod elements with each nodal element being substantially spherical and having a plurality of channels formed on its peripheral surface, including a first channel encircling said nodal element so as to pass through the poles thereof. At least four other channels are spaced about the peripheral surface so as to be intercepted by said first channel adjacent the poles of the nodal element, the lips of each said channel having inwardly projecting beads thereon. The rod element has a shank with a connecting portion at each end with a cross-section of a shape which can be "push-fitted" into a co-operating channel and held so that the longitudinal axis of the rod element is in substantial alignment with the geometrical center of the nodal element.

7 Claims, 7 Drawing Figures

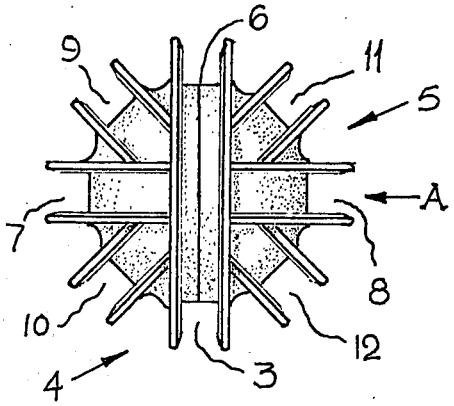
~Fig. 1.~
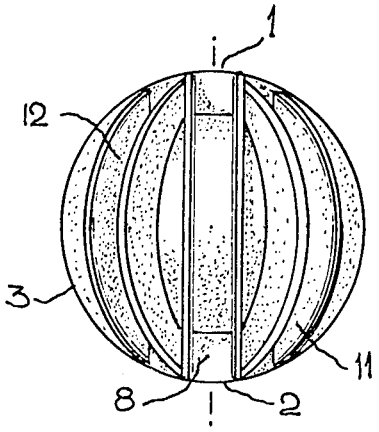
~Fig. 2~
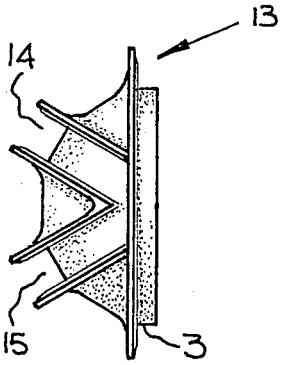
~Fig. 3~
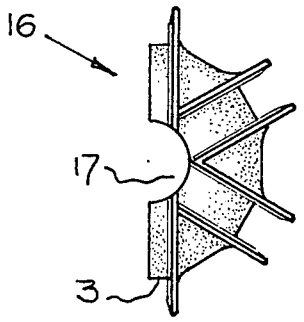
~Fig. 4~
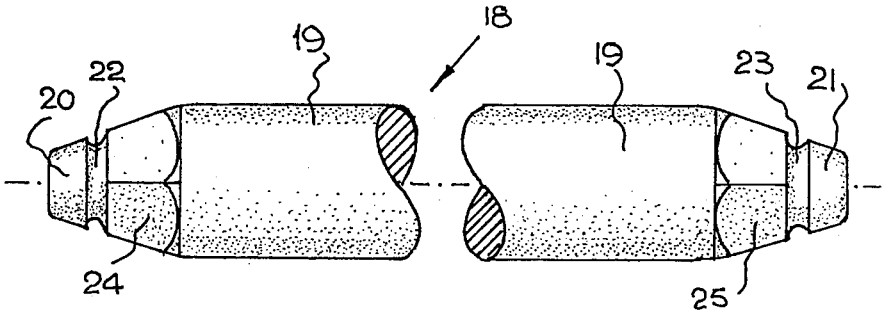
~Fig. 5~

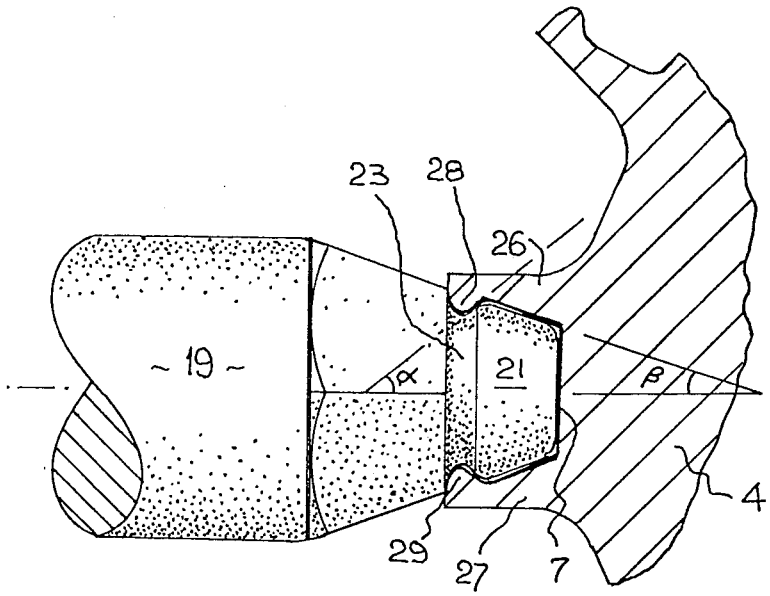
~Fig. 6~
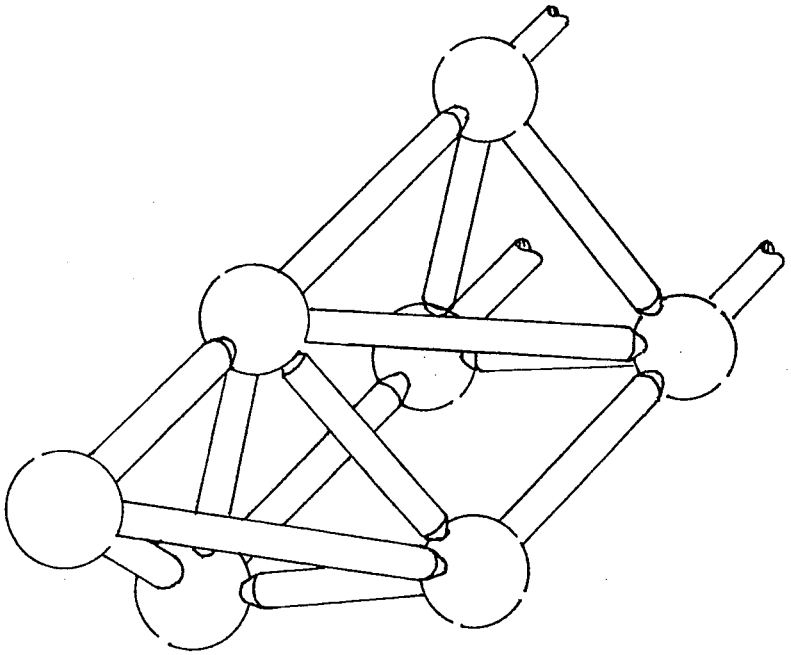
~Fig 7~

NODAL ELEMENTS WITH CHANNELS FOR PUSH-FITTED RODS

This invention relates to constructional toys and more particularly to a kind of constructional toy which is intrinsically more versatile and faster to use than any hitherto known.

The range of constructional toys available today for children older than six years is small and generally unappealing.

There are two major problems associated with this section of the toy market. Firstly, the short attention span of many of today's television-oriented children requires a toy to provide immediate gratification—the 'push-together' ease of "Lego" is now a minimum standard. Secondly, there is considerable buyer resistance to constructional toys which manifestly do not contain sufficient components to build the impressive models so often seen in shop-window displays and advertising literature. Because so many accessories are required to fully realize these prior art constructional toy systems, the buyer of these may not know where to start, or, indeed, where the costs of such will end!

Therefore, it is an object of the present invention to overcome the above and other disadvantages by providing a constructional toy comprising a plurality of nodal elements; each of the nodal elements being substantially spherical and having a plurality of channels formed upon its peripheral surface, including a first channel which encircles the nodal element so as to pass through its poles (to be later defined herein) and at least four other channels spaced about the said peripheral surface so as to be intercepted by the first channel adjacent the poles of the nodal element. The lips of each of the said channels are each provided with an inwardly-projecting bead.

Each rod element comprises a shank which may be of circular cross-section having a connecting portion at each end, the connecting portion including an annular groove and having a longitudinal cross-section of substantially the same configuration as the transverse cross-section of each of the channels; whereby, when a said connecting portion of a said rod element is 'push-fitted' into a co-operating channel, it is held therein by virtue of the engagement of a said lip bead within the annular groove of the connecting portion in such a manner that the longitudinal axis of the said rod element is substantially in alignment with the geometrical centre of the nodal element. Preferably, each nodal element is composed of two mating hemispherical portions the mating areas of which abut in a plane passing through the said poles of the completed sphere.

Because of the way in which children use any constructional toy, versatility was made the top priority in the design of the components of the present invention. Given a constructional set of a certain size, most children will build until they run out of a vital component, often leaving many unusable parts and a frustrated child. The constructional toy according to the present invention will usually leave but few unusable parts, particularly the nodal and rod elements which make up the bulk of the set.

Other design criteria, in order of importance, were considered as follows:

1. Maximum versatility of each part—as discussed above and to provide the largest possible variety of structures per unit cost.

2. Rapid assembly and disassembly.
3. A single construction system must be utilised.
4. Engineering principles must be able to be illustrated as graphically as bricklaying systems can be with block systems.
5. Random or violent disassembly must not damage the parts.
6. Tenacity of connections must not be dependent on close tolerance interference fits which may be affected by wear.
7. Parts must be large enough to be not easily lost.
8. Sharp edges and corners must be eliminated to prevent soreness to fingertips after an extended period of use.

In order that the reader may gain a better understanding of the present invention, hereinafter will be described a preferred embodiment thereof, by way of example only and with reference to the accompanying drawings in which:

FIG. 1 is a plan view of a nodal element of the constructional toy according to the present invention;

FIG. 2 is a side elevation from A on FIG. 1;

FIG. 3 shows a half of the nodal element of FIG. 1;

FIG. 4 shows a similar hemisphere but having a pole to pole half-bore;

FIG. 5 illustrates a rod element;

FIG. 6 shows how nodal and rod elements fit together; and

FIG. 7 is a schematic drawing of a portion of a space-frame constructed from components made according to the present invention.

It is envisaged that the constructional toy may contain, say, 60 to 120 nodal elements and 80 to 160 rod elements—a ratio of nodal elements to rod elements of 3:4.

As is to be seen from FIGS. 1 to 4, each nodal element is made in two halves, of some suitable material such as nylon, which may be fabricated so as to 'snap-fit' together but may be taken apart for a reason to be seen later herein. To draw an analogy from the terrestial globe, each nodal element has poles 1 and 2 through which the encircling first channel 3 passes. The plurality of nodal elements is composed of four species of hemispherical portions each of which is provided with a number of what may be thought of as 'longitudinal' channels, that is to say, channels following lines of longitude on a globe. Such 'longitudinal' channels are intercepted by the first channel in the north and south polar regions.

FIG. 1 shows, in plan view, a nodal element composed of two hemispheres referenced 4 and 5, these being, of course, of the same external appearance. Each hemisphere mates with its fellow in a plane 6 passing through the poles of the nodal element. Each hemisphere 4,5 has three longitudinal channels; channels 7,8 are intercepted by the first channel 3 at 90° and channels 9, 10, 11 and 12 at 45°; FIG. 2 shows the nodal element from the point A on FIG. 1.

In FIG. 3 there is shown half of a nodal element, 13, of a second species which has two longitudinal channels 14,15 which are intercepted by the first channel at 60°. FIG. 3 illustrates a third species which is a '60°' hemisphere 16 generally similar to 15 but having half of a cylindrical bore extending through from pole to pole. When two such hemispheres are mated, the resulting bore is such that the shank of a rod element—later to be described herein—is able to be slidably accommodated therein. Although not illustrated, needless to say an exactly similar bore may be provided in a '45°' hemisphere to constitute the fourth species.

The four hemisphere species described above may be variously mated to form:

1. nodal elements having a first channel and six other channels;
2. nodal elements having a first channel and six other channels, and a central bore;
3. nodal elements having a first channel and four other channels;
4. nodal elements having a first channel and four other channels, and a central bore;
5. nodal elements having a first channel, three other channels on one side and two on the other; and
6. nodal elements having a first channel, three other channels on one side, two on the other, and a central bore.

FIG. 5 shows a rod element, to an enlarged scale. Rod element 18 is ideally injection moulded from high impact polystyrene and includes a shank 19 of circular cross-section having a connecting portion 20,21 at each end. These connecting portions 20,21 each include an annular groove, 22,23 respectively, and have longitudinal cross-sections of substantially the same configuration as the transverse cross-section of each channel. This matter will be described hereinafter with reference to FIG. 6 of the drawings. Between shank 19 and connecting portions 20,21 are hexagonal nuts, 24,25 respectively, these hexagonal nuts tapering from the shank to the annular grooves.

The design of the above-described rod elements determines much of the flexibility of the present constructional toy and to this end the rods must, among other considerations:

(a) be robust;
(b) allow free spinning in bearing configurations;
(c) allow attachment of fixed drives to transmit torque through a rod; and
(d) cease to drive, without damage, if excessive torque is applied.

Condition (b) is satisfied by the shank 19 being of circular cross-section and adapted to slidably move and to spin within the central bore of a nodal element of the kind provided with such. However, such a shank could well include a flat or spline groove as a drive means. Conditions (c) and (d) are satisfied by the tapered hexagonal nuts 24,25 on each rod element inasmuch that ancillary parts such as wheels, gears or pulleys may be made to fit onto a hexagonal nut and be held there by a bead snap-fitting into the associated annular groove. A torque overload will have the effect of snapping the bead out of the groove and the wheel or the like off the hexagonal nut, and thus damage to the parts is averted.

The rod elements of the constructional toy may well be provided in a number of different lengths, selected to aid in the construction of triangulated right angle systems but not precluding the construction of other, less universal systems. Rod length may be expressed as 'notional length', as this is the most important dimension so far as the geometry of a structure is concerned. The actual rod element length is one nodal element diameter less than the 'notional length', and it is preferable that they should be provided in, say, seven lengths per set of components, with the middle size D, perhaps 85 mm, the most numerous. All other rod elements are in a set ratio to this length. Thus A is the shortest at D/2 and G the longest at $2\times D$. B is the hypotenuse of an AAB triangle and C the hypotenuse of an ABC triangle; E is the hypotenuse of a DDE triangle and F the hypotenuse of a DEF triangle. These lengths permit the construction of four braced (triangulated) squares, four braced rectangles, three more unbraced squares and seventeen unbraced rectangles. Most of the unbraced configurations may be triangulated with an adjustable length rod, as later described herein.

FIG. 6 is a much enlarged view showing how the nodal element and rod elements fit together. Referenced as in FIG. 1, the fragment is of a 45° hemisphere 4. Channel 7 is exemplary of all the channels of the nodal elements of the invention and has a pair of sides or lips 26,27 each being provided with an inwardly projecting bead, as 28 and 29. The connecting portion, as 21 in FIG. 5, 'snap-fits' into the channel 7 so that the beads 28,29 snugly engage the annular groove 23 in such a way that the longitudinal axis, that is to say, the axis of rotation, of shank 19 is aligned with the geometrical centre of the spherical nodal element.

As indicated in FIG. 6, the inner angle $\alpha$ of beads 28,29 is greater than the taper angle $\beta$ of the 'nose' 21 (ideally, $\alpha$ may equal approximately $2\times\beta$) so that the 'push-in' connection is easily made but not easily broken by direct tension. The rod element may be 'bent' out of the channel very easily during disassembly but a rigid joint can be made by using an ancillary component, to be described hereinafter. Such rigid joints are needed only for axles, levers and the like, a well-designed structure usually requiring strength in tension and compression only.

FIG. 7 is a schematic drawing of a portion of a spaceframe constructed from the nodal and rod elements as described above. The nodal elements are depicted as spheres in the interests of clarity and the rod elements' connecting portions are simplified. The spaceframe shown comprises triangles, and braced and unbraced rectangles.

Spaceframe structures in normal engineering practice are composed of a number of struts joined to each other at a number of nodes. The position of each node is completely defined by the lengths of its adjoining struts and the positions of the adjacent nodes. As long as the centre lines of all the adjoining struts pass through the 'nodal point', the joints at that node may be flexible but without any loss of structural rigidity. Thus, the nodal and rod elements of the constructional toy of the present invention teach the technique of triangulation and so model a real engineering situation.

As might well be imagined, a sophisticated constructional toy such as has been described and illustrated above may well include several ancillary components and accessories, some of which have been previously mentioned. As these form no part of the present invention, it will suffice to describe them briefly without the need for drawings. The design of ancillary parts to complement the nodal and rod elements follows in response to practical need and to the constraints necessarily imposed by their design geometry, as follows:

Wheels may be of a single width but of, say, two diameters; these may have means to 'snap-fit' together to form double- or triple-width wheels suitable for different models. A detachable drive hub of the 'basic' wheel is envisaged to be formed so as to push on the hexagonal nut of a rod element and to have an annular bead which will engage the groove, 22,24, of a rod element. Such wheels may also be arranged to spin freely without recourse to detachable drive hubs.

These wheels may have removable tires which when removed result in the wheels becoming effective pulleys.

Gears may be included, such as in four spur gear sizes and one size of bevel gear pairs. This will allow the construction of a multi-ratio gear box and a differential drive. Such pulleys and gears may be snapped onto the connecting portions of rod elements or, having internal flats or lands, slid onto a rod-element shank provided with a driving flat.

Adaptor units may be snapped onto a rod element end to provide an increased bearing surface to give a bending-resistant joint between rod element and nodal element.

Tubular rod extenders are also contemplated; these may be made to snap on to an annular groove of a rod element connecting portion and have an externally threaded portion. A co-operating element, of varying length, has an internally threaded bore so as to enable the actual and nominal lengths of a given rod element to be extended as required.

From the abovegoing, it will be appreciated that a contructional toy made in accordance with the present invention will present to the public a new and much-improved article or, at the very least, offer to it a useful and most attractive choice.

I claim:

1. A constructional toy comprising a plurality of nodal elements and a plurality of co-operating rod elements; each said nodal element being substantially spherical and having a plurality of channels formed upon its peripheral surface, including a first channel encircling said nodal element so as to pass through the poles thereof (as hereinbefore defined) and at least four other channels spaced about said peripheral surface so as to be intercepted by said first channel adjacent the poles of said nodal element, the lips of each said channel having inwardly projecting beads thereon;

each said rod element comprising a shank having a connecting portion at each end thereof, said connecting portion including an annular groove and having a longitudinal cross-section of substantially the same configuration as the transverse cross-section of each said channel; whereby, when a said connecting portion of a said rod element is 'push-fitted' into a co-operating channel, it is held therein by virtue of the engagement of a said lip bead within the annular groove of said connecting portion in such a manner that the longitudinal axis of the said rod element is in substantial alignment with the geometrical centre of the nodal element.

2. The constructional toy as claimed in claim 1, wherein each said nodal element is composed of two mating hemispherical portions the mating areas of which abut in a plane passing through the said poles of the completed sphere.

3. The constructional toy as claimed in claim 1 or claim 2, wherein each one of a number of nodal elements of said plurality of such has a central bore extending from pole to pole, the diameter of said bore being such that a shank of a said rod element is able to be slidably accommodated therein.

4. The constructional toy as claimed in claim 1 or claim 2, wherein each one of a number of nodal elements of said plurality of such has only four of said other channels.

5. The constructional toy as claimed in claim 1 or claim 2, wherein each one of a number of nodal elements of said plurality of such has six of said other channels.

6. The constructional toy as claimed in claim 1 or claim 2, wherein each one of a number of nodal elements of said plurality of such has five of said other channels, three of said other channels being on one hemisphere and two on the other.

7. The constructional toy as claimed in claim 1 or claim 2, wherein each said rod element includes, between said shank and said connecting portion at each end thereof, a hexagonal nut which tapers from said shank to said annular groove of said connecting portion.

* * * * *